United States Patent [19]

Young

[11] 4,205,317

[45] May 27, 1980

[54] BROADBAND MINIATURE ANTENNA

[75] Inventor: Paul T. K. Young, Westwood, Mass.

[73] Assignee: Louis Orenbuch, Weymouth, Mass.

[21] Appl. No.: 971,652

[22] Filed: Dec. 21, 1978

[51] Int. Cl.[2] ..... H01Q 21/12; H01Q 9/44

[52] U.S. Cl. ..... 343/720; 343/802; 343/811

[58] Field of Search ..... 343/720, 802, 803, 810, 343/811, 812, 814

[56] References Cited

U.S. PATENT DOCUMENTS

| | | | |
|---|---|---|---|
| 3,261,019 | 7/1966 | Lundy | 343/720 |
| 3,389,396 | 6/1968 | Minerva et al. | 343/811 |
| 3,564,555 | 2/1971 | Rosenberry | 343/811 |

*Primary Examiner*—Eli Lieberman

*Attorney, Agent, or Firm*—Wolf, Greenfield & Sacks

[57] ABSTRACT

A broadband antenna of miniature size employs an array of dipole elements whose inner ends are connected to a pair of closely spaced parallel central conductors. Three pairs of dipole elements are disposed in a symmetrical array and extend outwardly from the central conductors. The longest pair of dipole elements are capacitively end loaded and the length of that longest pair is approximately one eighth of a wavelength at the lowest frequency in the broadband. The length of the shortest pair of dipole elements is in the range of a third to a quarter of the wavelength at the highest frequency in the broadband. The third pair of dipole elements is a half wavelength at an intermediate frequency in the broadband. At the points where their inner ends are connected to the central conductors, adjacent pairs of dipole elements are spaced apart by a distance in the range of a half to a quarter of the wavelength at the highest frequency in the broadband. To enable the antenna array to be disposed on a support that is suitable for a picture frame, the dipole elements are slanted with respect to the central conductors and the two longest pairs of dipole elements are arranged to approach convergence at their outer ends. To provide two panels, each of which can act as a frame for a picture, the support can be hinged with the hinge being disposed between the closely spaced parallel central conductors.

4 Claims, 10 Drawing Figures

Fig. 6
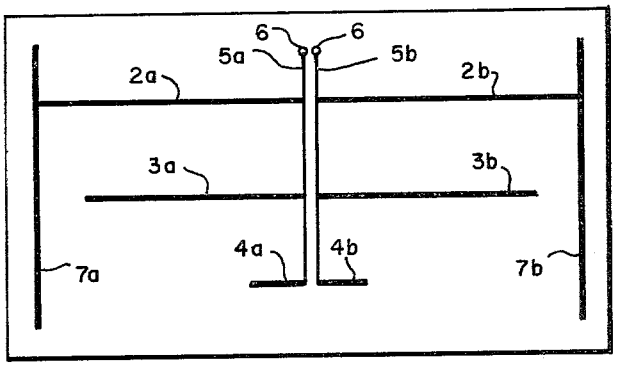
Fig.7
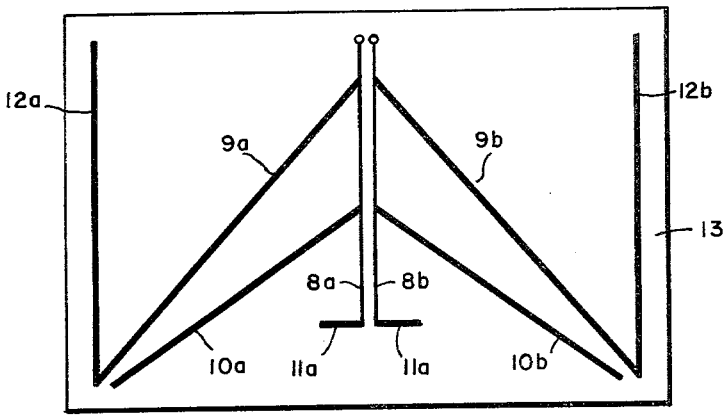
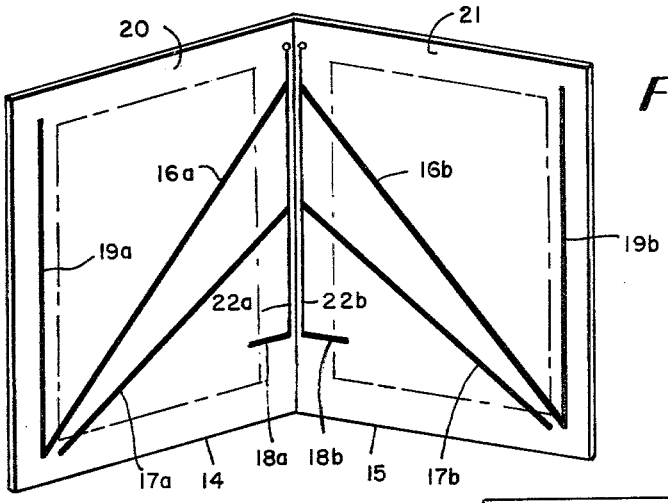
Fig. 8
Fig. 9
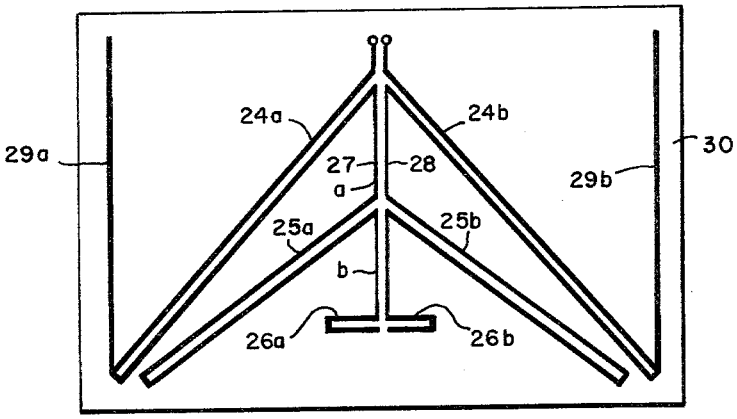

BROADBAND MINIATURE ANTENNA

FIELD OF THE INVENTION

This invention relates in general to antennas for the reception of electromagnetic wave energy. More particularly, the invention pertains to a broadband antenna of small size that is capable of receiving signals over an extremely broad frequency spectrum extending from the low VHF band (54-88 MHz) used for TV broadcasts to the upper end of the UHF TV broadcast band (470-890 MHz).

BACKGROUND OF THE INVENTION

The conventional indoor TV antenna used to receive the VHF bands employs a pair of telescopic elements forming a dipole with each of the elements having a maximum length of from 4' to 6'. The two elements usually are mounted to permit the elements to be spread apart to increase or shorten the dipole length and those elements are commonly referred to as "rabbit ears". In addition, it is customary to provide a separate antenna for indoor reception of the UHF TV band. The indoor UHF antenna typically is a loop having a diameter of about 7½" or is of the type known as a "bow-tie antenna". The conventional TV indoor antennas are unsightly because of their configuration and the size of the VHF indoor antenna makes it especially difficult to conceal or blend with the decor of a room.

OBJECT OF THE INVENTION

The principal object of this invention is to provide a broadband miniature antenna for indoor TV reception that is of such small size as to enable the antenna to be concealed in a picture frame or similar article that can blend with conventional room furnishings.

THE INVENTION

The invention resides in a broadband antenna having an array of dipole elements connected at their inner ends to a pair of closely spaced parallel conductors. In the preferred embodiment of the invention, three pairs of dipole elements are arranged symmetrically to extend outwardly from the closely spaced parallel conductors. The combined length of the longest pair of dipole elements is approximately one eighth of a wavelength at the lowest frequency in the broadband and that pair of dipole elements is capacitively end loaded to improve the antenna's performance at the low frequency end of the broadband. The combined length of the shortest pair of dipole elements is in the range of a third to a quarter of the wavelength at the highest frequency in the broadband. The combined length of the third pair of antenna elements is a half wavelength at some intermediate frequency in the broadband. The pairs of dipole elements, at the points where their inner ends are connected to the closely spaced parallel conductors, are spaced apart by a distance that is in the range of a half to a quarter of wavelength at the highest frequency in the broadband. The dipole may form an array of parallel elements. However, to enable the antenna array to be disposed on a support that is suitable for a picture frame, the dipole elements can be slanted with respect to the closely spaced parallel conductors and the two longest pairs of dipole elements can be arranged toward convergence at their outer ends. The support can be hinged along its center to provide two panels, each of which can act as a frame for a picture.

THE DRAWINGS

FIG. 1A schematically depicts a conventional half wavelength single dipole antenna.

FIG. 1B schematically depicts a conventional half wavelength folded dipole antenna.

FIG. 2 schematically depicts the use of series inductors to increase the effective dipole antenna length.

FIG. 3 schematically depicts the use of series capacitors to decrease the effective dipole antenna length.

FIG. 6 schematically depicts an embodiment having capacitive end loading.

FIG. 7 schematically depicts an embodiment of the invention having angularly disposed convergent antenna elements.

FIG. 8 shows the invention embodied in a picture frame having two hinged panels.

FIG. 9 depicts the preferred embodiment of the invention.

DETAILED DESCRIPTION OF PREFERRED EMBODIMENTS

Tabulated below are half wavelengths ($\lambda/2$) for the frequencies of the TV VHF and UHF bands and the FM broadcast band.

| Band | Channel | Frequency Range | $\frac{\lambda}{2}$ |
|---|---|---|---|
| VHF | 2 to 6 | 54MHz to 88MHz | 100" to 66" |
| FM | Broadcast | 88MHz to 108MHz | 64" to 52" |
| VHF | 7 to 13 | 174MHz to 216MHz | 32" to 16.5" |
| UHF | 14 to 83 | 470MHz to 890MHz | 11.9" to 6.3" |

Figure 1A:
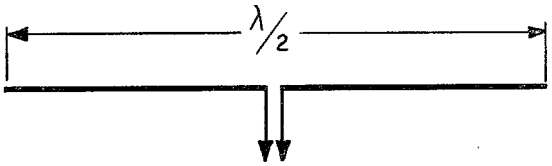
Figure 1B:
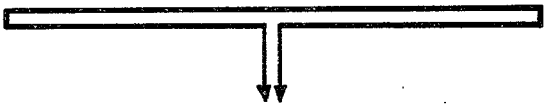

For the conventional single dipole antenna depicted in FIG. 1A and the conventional folded dipole antenna shown in FIG. 1B, the length of the dipole antenna is matched to the $\lambda/2$ wavelength for a particular frequency to obtain maximum signal reception. Where the antenna falls short of $\lambda/2$ length, a degradation in signal pick up results which can affect the operation of the receiver if the signal is too weak. However, where the antenna exceeds the $\lambda/2$ length, the antenna can still operate with good results as a "long wire" harmonic antenna.

Figure 2:
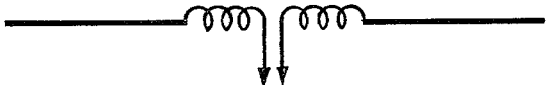
Figure 3:
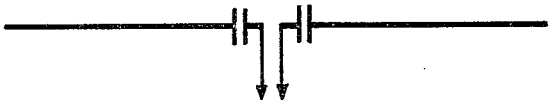

It is well known that the effective dipole antenna length can be increased by the addition of series inductance as depicted in FIG. 2. Although the physical length of the FIG. 2 antenna is shown to be the same as the FIG. 1 antennas, the effective length of the FIG. 2 dipole antenna is greater because of the series inductors. As a corollary, which is well known, the effective dipole antenna length can be decreased by the addition of series capacitance as shown in FIG. 3. Thus, although the FIG. 3 antenna is physically the same length as the FIG. 1 antennas, the effective length of the FIG. 3 dipole antenna is shorter because of the series capacitors.

Figure 4:
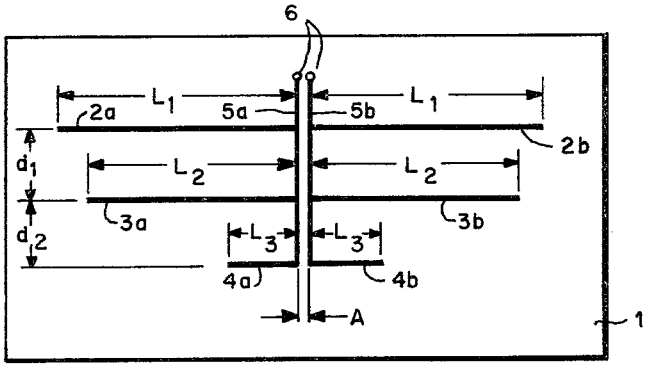
FIG. 4 shows an orthogonal embodiment of the invention.

A broadband miniature antenna constructed in accordance with the invention is schematically depicted in FIG. 4. The antenna elements are fine copper wires or are thin narrow strips of copper. The array of wires or copper strips is supported on a flat rigid structure 1 of an insulative material that does not absorb RF wave energy. The array employs three parallel pairs of dipole elements. In the array, dipole elements 2a and 2b are each of length L1 and are spaced by the distance d1 from the second pair of shorter elements 3a and 3b, each of which is of length L2. The third pair 4a, 4b of antenna elements, each of which is length L3, is spaced by distance d2 from parallel dipole elements 3a and 3b. At their inner ends, dipole elements 2a, 3a, and 4a are connected to a conductor 5a which is spaced by the distance A from a parallel conductor 5b to which the inner ends of antenna elements 2b, 3b, and 4b are connected. The conductors 5a and 5b are connected to the antenna output terminals 6. In a typical array of the FIG. 4 arrangement, the dimensions are as follows L1=14"
L2=10"
L3=2"
d1=6"
d2=5"
A=0.25"

For low frequency operation in the band from 54 MHz to 108 MHz, it is evident that the 28" length (2L1) of the longest pair of dipole elements 2a and 2b is far short of the optimum λ/2 length. The combined length of those dipole elements is approximately one eighth of the wavelength of the lowest frequency in the low VHF band. The 28" length of elements 2a and 2b performs adequately as a low frequency band antenna because the spacing *d1* and *d2* between adjacent dipole elements is a small fraction of the wavelengths for the frequencies in that band. Consequently, the close proximity causes inductive and capacitive coupling between the adjacent dipole elements. The net result is that dipole elements 3a, and 3b, 4a, 4b appear as inductors in series with elements 2a, 2b and increase the effective length of elements 2a and 2b while the capacitive coupling is neglible at the relatively low frequencies here considered. As the received frequencies rise into the high VHF and UHF bands, the series inductive effect decreases while the series capacitive effect becomes increasingly dominant. As the frequencies enter the UHF band, the d1 and d2 spacings approach λ/2 in length and greatly decrease the inductive coupling effect, causing dipole elements 2a, 2b to act as a "long wire" antenna. Consequently, the effective length of the antenna tends to be self adjusting over a broad band of frequencies.

The combined length of dipole elements 3a and 3b is a half wavelength at a frequency in the upper VHF TV band. Those dipole elements and dipole elements 2a and 2b act as resonant "long wire" antennas for frequencies in the UHF TV band inasmuch as at certain UHF frequencies those dipoles are integral multiples of a half wavelength. The combined length of the shortest pair of dipole elements 4a and 4b is approximately a third of a wavelength at the highest frequency in the UHF TV band.

The closely spaced parallel conductors 5a and 5b are spaced apart by ¼". The conductors of the standard 300 ohm twin lead line used in the United States are also separated by ¼". The ¼" spacing of conductors 5a and 5b is convenient because it enables ready connection to the standard 300 ohm twin lead without appreciable impedance mismatch.

Figure 5:
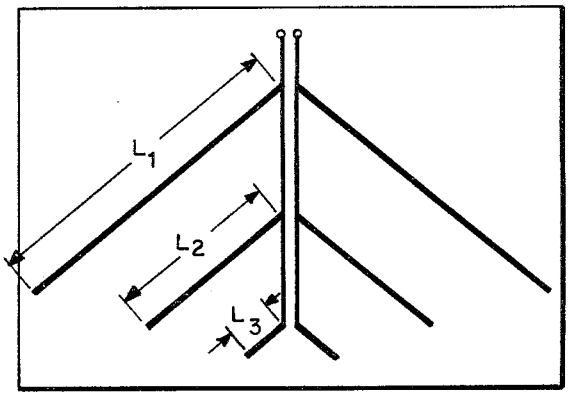
FIG. 5 shows an embodiment of the invention having the antenna elements angularly disposed in a parallel array.

To reduce the size of the antenna, the array of dipole elements can be angled with respect to conductors 5a and 5b, as depicted in FIG. 5, to maintain the same element lengths and spacing while reducing the overall size of the array. With the angled array, the basic electrical characteristics remain the same. However, in the UHF band, the angled array exhibits a better broadside response than the orthogonal FIG. 4 arrangement.

Some improvement in performance may be obtained by capacitively end loading dipole elements 2a and 2b as shown in FIG. 6. The end loads 7a and 7b may simply be conductive wires or thin strips attached to the outer ends of the antenna elements 2a and 2b.

FIG. 7 shows a modification of the angled array in which the pairs of dipole elements are not parallel but rather extend from the closely spaced parallel central conductors 8a and 8b at different angles. In the FIG. 7 embodiment, dipole elements 9a and 9b are slanted toward convergence with dipole elements 10a and 10b. The basic inductive and capacitive coupling effect still occurs. By angling the longer dipole elements, the antenna can be made to fit upon a support 13 of modest size which can readily be disposed atop a television receiver cabinet. Directing dipole elements 9a and 9b toward the corners of support 13 permits those elements to be of maximum length and permits capacitive end loading elements to run adjacent to the lateral edges of the support. Inasmuch as dipole elements 9a and 9b tend to converge at their outer ends with the tips of dipole elements 10a and 10b, an increase in capacitive and inductive coupling between the antenna dipole elements is obtained.

FIG. 8 schematically depicts an embodiment of the broadband antenna arranged on a support having two hinged panels 14 and 15, each of which acts as a picture frame. Each of those panels has disposed on it an array of antenna elements which is the mirror image of the array on the opposite panel. By causing the two panels to assume a V-shape, the support can be made to stand upright on a flat surface such as the top of a TV receiver cabinet. To make dipole elements 16a and 16b of maximum length, those elements are arranged diagonally on the panels 14 and 15. The shorter dipole elements 17a and 17b are slanted to approach the outer ends of the longer elements. The shortest antenna elements 18a and 18b need not be slanted as those elements can easily fit in the space available on the panels 14 and 15. Dipole elements 16a and 16b are capacitively end loaded by attached conductive strips 19a and 19b which extend vertically adjacent the outer lateral edges of the panels.

To enable the panels to be of a size to accommodate the diagonal length of elements 16a and 16b, each of which should be approximately 14" in length, mats 20 and 21, indicated in phantom in FIG. 8, are secured to the panels to provide wide borders around the opening in which a picture, such as a photograph, is displayed. For example, to accommodate the display of an 8"×10" photograph, the mat should preferably provide at least 1" borders around the picture so that the panel will be about 10"×12" in size.

The hinge panels 13 and 14 is centered between the parallel conductors 22a and 22b. Inasmuch as none of the conductive elements of the antenna need extend over the hinge, folding and unfolding of the panels is facilitated. Further, some tuning of the antenna can be obtained by moving the panels together or swinging them farther apart. The antenna can readily be turned to face in the direction for best signal reception.

The size of the antenna can be decreased with an attendant reduction in performance at the low frequency end of the band. For example, an antenna having the following dimensions can provide adequate performance in locales where the signals at the low frequency end of the band are strong L1=12"
L2=8"
L3=1½"
d1=5"
d2=3½"
A=0.25"

An antenna with those diminished dimensions can be disposed on two 8"×10" hinged panels having mats providing 1½" borders to accommodate 5"×7" pictures.

In the reduced size antenna, the combined length of the shortest pair of dipole elements is approximately a quarter wavelength at the highest frequency in the UHF TV band. Further, the spacing l*d* and d2 between adjacent dipole elements where those elements are attached to the central conductors can approach a quarter of a wavelength at that highest frequency.

In the preferred embodiment of the invention depicted in FIG. 9, each of the dipole elements 24*a*, 24*b*, 25*a*, 25*b*, 26*a*, 26*b* is formed by two parallel conductive strips of 1/16" wide thin copper foil which are spaced by ¼" to have the same spacing as the central conductors 27 and 28. At the outer end of each dipole element, the two conductive strips are terminated in a short circuit. At the inner end of the dipole element, the element is attached to a central conductor in a manner such that the central conductor does not short circuit the two conductive strips of the dipole element. For that reason, each central conductor is divided into segments which are electrically connected by the two parallel conductive strips of an antenna element. For example, the upper conductive strip of dipole element 25*a* is connected to segment a of central conductor 27 and the lower conductive strip of that dipole element is connected to segment b of central conductor 27.

In the preferred embodiment shown in FIG. 9, the capacitive end loads 29*a* and 29*b* which are attached to the outer ends of the longest pair of dipole elements 24*a* and 24*b* are formed of single strips of thin copper foil extending adjacent to the lateral edges of support 30. Inasmuch as the two halves of the antenna are separated by the gap between the central conductors 27 and 28, the support can be divided into two hinged panels with the hinge being disposed in the gap. To utilize each of the panels as a picture frame, a mat can be placed over each panel to form a frame around a picture as previously described.

I claim:

1. A broadband antenna comprising (1) a pair of parallel closely spaced elongate central conductors, each of said central conductors being connected at one end to antenna output terminal means, (2) a plurality of pairs of dipole elements, the two elements of each pair being equal in length, the elements of each pair being disposed symmetrically on opposite sides of said closely spaced central conductors and extending outwardly therefrom, each element having its inner end connected to the adjacent one of the pair of closely spaced central conductors, (3) the length of the longest pair of dipole elements being approximately one eighth the wavelength of the lowest frequency in the broadband, (4) the length of the shortest pair of dipole elements being in the range of one third to one quarter of the wavelength of the highest frequency in the broadband, (5) the length of a third pair of dipole elements being a half wavelength at some intermediate frequency in the broadband, the third pair of dipole elements being disposed between the longest and shortest pair of dipole elements, and (6) adjacent pairs of dipole elements being spaced apart at their points of attachment to the central conductors by a distance in the range of a half to a quarter of the wavelength at the highest frequency in the broadband.

2. A broadband antenna according to claim 1, further comprising (7) electrically conductive means attached to the outer ends of the longest pair of dipole elements and providing capacitive end loads for those elements.

3. A broadband antenna according to claim 2, further including (8) a pair of hinged panels on which the antenna is mounted, the hinge of the panel being disposed between the pair of parallel closely spaced elongate conductors.

4. A broadband antenna according to claim 3, wherein at least the longest and next longest pairs of dipole elements are disposed along convergent paths.

* * * * *